United States Patent [19]

Lampe et al.

[11] 4,023,739

[45] May 17, 1977

[54] LINING ELEMENT FOR PULP REFINERS

[75] Inventors: Väino Lampe; Karl-Erik Johansson, both of Hagfors, Sweden

[73] Assignee: Uddeholms Aktiebolag, Hagfors, Sweden

[22] Filed: Apr. 5, 1976

[21] Appl. No.: 673,943

[30] Foreign Application Priority Data

Apr. 9, 1975 Sweden ..... 7504056
Sept. 8, 1975 Sweden ..... 7509957

[52] U.S. Cl. ..... 241/296; 75/122; 75/123 R; 75/126 R; 75/128 R

[51] Int. Cl.[2] ..... B02C 7/12

[58] Field of Search ..... 241/296; 75/123 R, 122, 75/126 R, 128 R R

[56] References Cited

UNITED STATES PATENTS

| | | | |
|---|---|---|---|
| 3,369,891 | 2/1968 | Tarkan et al. | 75/128 B |
| 3,653,982 | 4/1972 | Prill | 148/31 |
| 3,966,423 | 6/1976 | Mol et al. | 75/123 J |

*Primary Examiner*—Arthur J. Steiner
*Attorney, Agent, or Firm*—Pierce, Scheffler & Parker

[57] ABSTRACT

A lining element for pulp refiners is made by casting from a steel alloy containing from 1.0 to 5 percent by weight of titanium present as titanium carbide grains having an average size of 10 microns or less and being uniformly distributed throughout the lining element. The titanium carbide prevents polishing of the working faces of the lining element.

6 Claims, 4 Drawing Figures

LINING ELEMENT FOR PULP REFINERS

BACKGROUND OF THE INVENTION

This invention relates to pulp refining apparatus, i.e. apparatus for producing and/or mechanically processing pulp, such as wood pulp and other fiber slurries. More particularly, the invention concerns a lining element for application to relatively rotatable backing members of a refiner, such as, for example, a face plate for a disc refiner.

A pulp refiner essentially is a milling apparatus used for producing pulp from wood chips or other fibrous raw materials and/or for processing pulp to modify the fibers to the desired condition. A common type of pulp refiner includes two relatively rotatable, concentric discs the confronting faces of which are lined with removable wear resistant face plates having a pattern of ridges and grooves. The lined refiner discs define between them a narrow annular clearance. The material to be refined is fed into this clearance at the center of the discs and is subjected to the refining action (i.e. the defibration of the wood and/or the conditioning of the fibers) of the ridges of the face plates as it flows radially outwardly through the clearance.

Face plates and other lining elements for pulp refiners are commonly cast from alloys of various types. Cast iron, stainless steel and other steel alloys containing nickel and molybdenum and various other ingredients are customary materials.

Lining elements for pulp refiners have to satisfy various requirements which are conflicting in some respects and which are difficult or even impossible to meet in one and the same lining element using the customary materials. For example, the lining elements should maintain an excellent and uniform refining action to be able to produce pulp of high and uniform quality throughout their life. Moreover, they should have high resistance to wear so as to have long life, as well as high impact strength to be able to resist the impact loads to which they may be subjected even in normal operation. A further desired quality is high resistance to corrosion and erosion. The material from which the lining elements is produced also should have good castability so that the elements can be cast in complicated shapes, and naturally the material should not be too expensive in relation to the properties of the finished elements.

A requirement related to the above-mentioned requirement for an excellent and lasting refining action is that the lining elements should be self-sharpening. This means that the lining element surfaces defining the narrow refining clearance, the working faces of the ridges, must not be polished too easily by the pulp, but must retain a certain limited, uniform roughness throughout the life of the element. Most known lining elements of alloyed steel require frequent regrinding of the working faces of the ridges, because these faces are rapidly polished by the pulp and because the edges of the ridges rapidly become blunt.

SUMMARY OF THE INVENTION

The present invention has for its general object of provide a refiner lining element meeting the above-stated requirements in an advantageous way. In accordance with the invention a pulp refiner lining element is made from an alloy containing between 1.0 and 5.0 percent by weight of titanium present as titanium carbide grains in a steel matrix, the titanium carbide grains being substantially uniformly distributed throughout the lining element and having a maximum average size of about 10 microns (throughout the specification and the appended claims, wherever numerical values of the average grain size are given, these values represent the nominal grain diameter, i.e. the square root of the average grain sectional area). Preferably, the average size is less than about 8 microns. For best results, the majority, preferably at least 95 percent and, still better, at least 99 percent, of the titanium carbide grains should have a size less than 10 microns. It is also preferred that the average size of the titanium carbide grains and the titanium content are matched such that the average distance between adjacent grains, as determined according to a technique herein termed "Nearest Neighbor Measuring Technique", abbreviated NNMT, is at least about 3 microns, preferably at least about 10 microns. The NNMT is described in detail in UNDERWOOD, E.E.: "Quantitive Stereology", Addison-Wesley, Reading, Mass. (1970), 84. An alternative technique, herein termed "Linear Measuring Technique", abbreviated LMT, includes determining the average distance between adjacent grains on a large number of randomly distributed and oriented straight lines on a photomicrograph. LMT figures for a given specimen are generally substantially higher than NNMT figures for the same specimen, and measurements on lining elements according to the invention have shown that the NNMT figures given above, i.e. 3 and 10 microns, roughly correspond to LMT figures of 15 and 30 microns, respectively. A preferred upper limit of the distance between adjacent titanium carbide grains is about 30 microns, NNMT (about 100 microns, LMT). Unless otherwise specified, the NNMT figures are used hereinafter.

As is well known, titanium carbide has properties which are very useful where hardness and wear resistance are desired. In the past, it has been customary to employ powder metallurgy techniques for making objects from alloys containing titanium carbide. One reason for this is that it is difficult to avoid excessive growth of the titanium carbide grains or the formation of large dendritic aggregates of titanium carbide grains. Since its is hardly feasible to employ any other method than casting for the production of lining elements of the kind referred to, the problems connected with titanium carbide and molten metallurgy techniques have to be considered.

In making the lining elements according to the invention, the just-mentioned problems are avoided by first providing a melt which is essentially free of titanium but has a carbon content corresponding to the desired total carbon content of the finished lining elements and then, immediately prior to the casting, combining this melt with titanium and any other alloy components that are still missing. Preferably, the titanium is added as ferrotitanium to the melt (which contains all the other essential alloy components) in the ladle or other container from which the molten alloy is poured into the casting mold. The titanium very quickly combines with a portion of the carbon to form titanium carbide, and because of the addition of titanium at a late stage, the time remaining until the casting in the mold has solidified is insufficient to permit the titanium carbide grains to grow to a harmful size or form unwanted aggregates; since lining elements of the kind referred to are relatively thin structures, the molten metal in the mold solidifies rapidly.

In use, it has been found that disc refiner face plates according to the invention are capable of producing pulp of high and uniform quality during extended periods of operation without regrinding of the ridges. For example, face plates made in accordance with the invention (approximate composition: C 1.6 %, Si 0.65 %, Mn 0.45 %, P 0.030 %, S 0.025 %, Cr 17.0 % Ni 1.60 %, Mo 0.70 %, Ti 2.3 %, Fe balance) have been used for pulp production for periods ranging from 1600 to 1900 hours without regrinding. Conventional face plates having approximately the same composition except for the titanium (no titanium) used under identical or similar conditions have required regrinding at intervals averaging approximately 600 hours. Assuming that both types of plates can be reground the same number of times before they have to be discarded, face plates according to the invention thus have a useful life approximately three times that of the titanium-free face plates.

In addition to the advantages of a substantially longer life and a uniform pulp quality, disc refiner face plates according to the invention have been found to reduce the specific energy consumption of the refiner considerably. In refiners having conventional face plates, the working faces of the ridges gradually become polished by the pulp, resulting in a gradually increasing specific energy consumption until the ridges are reground. In face plates according to the invention, on the other hand, the titanium carbide grains result in a constant self-sharpening of the working faces, and as a consequence of this self-sharpening, the specific energy consumption remains substantially constant and at a low level throughout the useful life of the face plates.

Examples of suitable alloy compositions for face plates and other lining elements according to the invention are given in Table 1 below. for some alloy components two percentage ranges are given, the narrower range being the preferred range. All percentage figures are by weight.

TABLE 1

| Alloy component | Alloy A | | | Alloy B | | | Alloy C | | | Alloy D | | | Alloy E | | |
|---|---|---|---|---|---|---|---|---|---|---|---|---|---|---|---|
| C | 0.9 | – | 1.8 | 0.4 | – | 1.3 | 0.4 | – | 1.2 | 1.3 | – | 2.2 | 0.5 | – | 1.8 |
| | 1.2 | – | 1.4 | 0.5 | – | 0.7 | 0.6 | – | 0.9 | 1.5 | – | 1.7 | 0.6 | – | 1.6 |
| Si | 0.3 | – | 0.5 | 0.3 | – | 0.5 | max. | | 0.4 | 0.5 | – | 0.7 | max. | | 2.0 |
| | | | | | | | | | | | | | 0.3 | – | 1.0 |
| Mn | 0.6 | – | 1.0 | 0.6 | – | 1.0 | max. | | 0.4 | 0.9 | – | 1.3 | max. | | 2.0 |
| | | | | | | | | | | | | | 0.2 | – | 1.0 |
| P | max. | | 0.03 | max. | | 0.03 | max. | | 0.03 | max. | | 0.03 | max. | | 0.03 |
| S | max. | | 0.03 | max. | | 0.03 | max. | | 0.03 | max. | | 0.03 | max. | | 0.03 |
| Cr | 0.8 | – | 5.0 | 10.0 | – | 15.0 | | — | | 10.0 | – | 15.0 | 14.0 | – | 20.0 |
| | 0.8 | – | 1.2 | 12.0 | – | 14.0 | | | | 11.5 | – | 13.5 | 16.8 | – | 18.0 |
| Ni | 2.5 | – | 8.0 | 4.0 | – | 12.0 | 12.0 | – | 20.0 | | — | | max. | | 3.0 |
| | 3.5 | – | 4.5 | 7.0 | – | 9.0 | 17.5 | – | 19.5 | | | | 1.0 | – | 2.0 |
| Mo | 1.5 | – | 5.0 | 1.0 | – | 3.5 | 3.0 | – | 6.0 | | — | | max. | | 2.0 |
| | 2.5 | – | 3.5 | 1.5 | – | 2.5 | 4.5 | – | 5.3 | | | | 0.5 | – | 1.0 |
| Ti | 1.5 | – | 5.0 | 1.5 | – | 5.0 | 1.5 | – | 5.0 | 1.5 | – | 5.0 | 1.5 | – | 5.0 |
| | 2.5 | – | 3.5 | 2.5 | – | 3.5 | 3.2 | – | 3.9 | 2.5 | – | 3.5 | 2.5 | – | 3.5 |
| Al | 0.06 | – | 0.2 | 0.5 | – | 2.5 | 0.03 | – | 0.3 | | — | | | — | |
| | | | | 0.7 | – | 1.3 | 0.06 | – | 0.2 | | | | | | |
| Co | | — | | | — | | 7.0 | – | 10.0 | | — | | | — | |
| | | | | | | | 8.1 | – | 9.5 | | | | | | |
| V | | — | | | — | | | — | | 0 | – | 1.5 | | — | |
| | | | | | | | | | | 0.6 | – | 1.0 | | | |
| Fe and impurities | balance | | | balance | | | balance | | | balance | | | balance | | |

As apparent from Table 1, the preferred titanium contents are always between 2.5 and about 4 percent by weight. The most suitable titanium content is normally in the range of 2.5 to 3.5 percent by weight. If the titanium content is too high, it may be difficult to avoid titanium carbide accumulations and consequent undesired fracture indications. In addition, the self-sharpening action of the lining elements is reduced at high titanium contents, above 5 percent by weight, because the average distance between the titanium carbode grains then becomes too small in relation to the diameter of the pulp fibers. The diameter of the fibers of those types of fibrous materials for which lining elements of the kind referred to are normally used is about 30 microns (this figure is a rough average value) and in view of this, the average distance between the titanium carbide grains should be at least 3 microns and most desirably should be at least 10 microns.

However, the self-sharpening action is also reduced if the average distance between the titanium carbide grains is too large, more than about 30 microns and for that reason a titanium carbide content below about 1.0 percent by weight may not be expected to produce sufficient self-sharpening.

Disc refiner face plates produced according to the above-described method from alloys of the compositions set forth in Table 1 have been found to have, in addition to other desired characteristics, a degree of incapability of becoming polished which, in terms of a surface finish factor herein termed average surface deviation (definition given hereinafter) is from twice to more than four times that of a customary material for face plates (alloyed cast iron).

BRIEF DESCRIPTION OF THE DRAWING

The invention will be described in greater detail hereinafter with reference to the accompanying diagrammatic drawing.

DETAILED DESCRIPTION OF THE DRAWING

Figure 1:
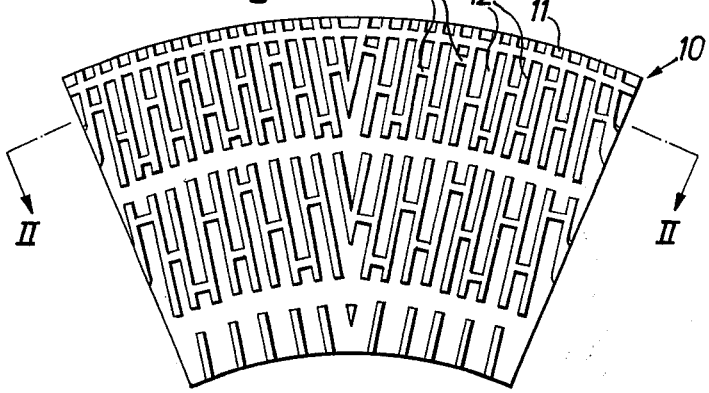
FIG. 1 shows a segment of a refiner face plate of known design.

In the drawing, FIG. 1 shows the front or working face of a refiner lining element in the form of a face plate 10 for a disc refiner for wood pulp. The face plate 10 is of known type and is provided with openings or other means (not shown) for mounting it on a circular supporting disc on which a plurality of similar face plates jointly form an annular refiner ring. The disc refiner includes two such coaxial refiner rings having their front faces disposed closely adjacent to each other to define a narrow refining clearance. In operation of the refiner, the fiber slurry or other fibrous material is processed by the relatively rotating refiner rings as it flows radially outwardly through this clearance.

Figure 2:
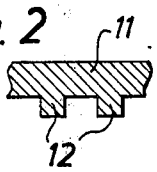
FIG. 2 is a fragmentary sectional view on the arcuate line II — II of FIG. 1.

As shown in FIGS. 1 and 2, the face plate 10 has a flat body 11 which carries on one face thereof, the front face, a plurality of substantially radial blades or ridges 12 and transverse short webs 13 between the ridges. The ridges and the webs are integral with the body. In operation of he refiner, the ridges cooperate with the ridges of the face plates of the opposing refiner ring to refine the fibrous material.

It should be noted that the cross-section of the face plate 10 is relatively thin throughout the face plate. Thus, on casting the face plate, the molten metal solidifies relatively rapidly throughout the cross-section.

In the past years, it has been customary to make the ridges of disc refiner face plates relatively narrow, such as 2 to 3 millimeters, to compensate for the disadvantages resulting from polishing of the ridges by the fibrous material being refined. Because of the self-sharpening action of face plates according to the present invention, the ridges need not be made that narrow, but can have a width of, for example, from 3 to 5 millimeters. This is an advantage, since the casting is simplified with wider ridges.

Figure 3:
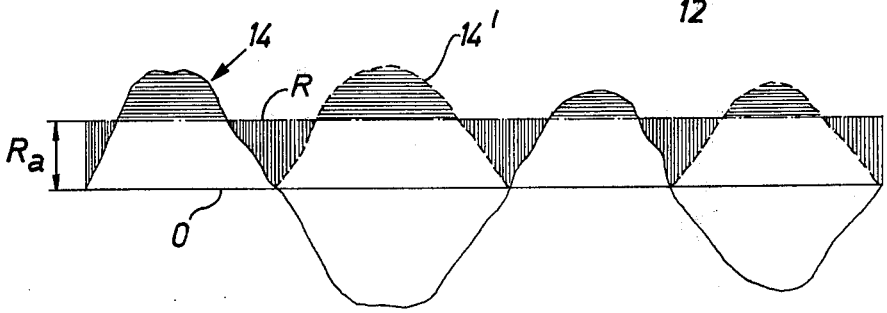
FIG. 3 is a diagram serving to illustrate the definition of an important property of refiner face plates.

FIG. 3 illustrates a surface finish factor, herein termed "average surface deviation", which is significant to the quality of the refined fibrous material. This figure shows an idealized cross-sectional profile contour 14 of the front or working face of one of the ridges 12. The mean line O of the profile contour 14 is a straight line located such that the surface area between the line and the profile contour segments above the line is equal to the surface area between the line and the profile contour segments below the line. The segments of the profile contour below the mean line O are mirrored about the mean line as shown in dash lines at 14' and for the purpose of defining the average surface deviation $R_a$ only the segments above the mean line and the mirrored segments, thus the "rectified" profile contour, are used.

The average surface deviation $R_a$ is herein defined as the distance between the mean line O and a second straight line R which is parallel to the mean line O and located such that the surface area between this second line R and the sections of the "rectified" profile contour located above it is equal to the surface area between the line R and the sections of the rectified profile contour located below it (these two surface areas are marked by horizontal and vertical shade lines in FIG. 3). Thus, the second line R may be regarded as the mean line of the rectified profile contour.

Figure 4:
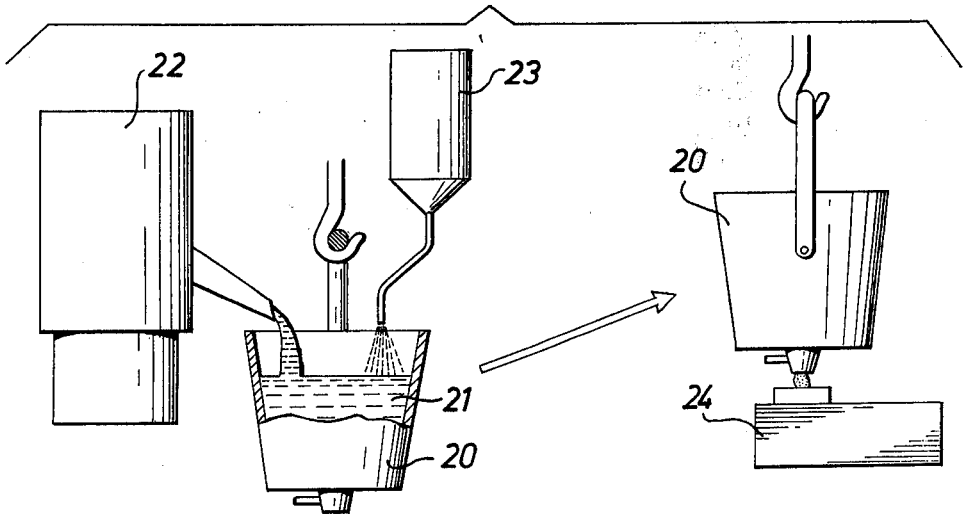
FIG. 4 is a diagrammatic illustration of one method of making lining elements according to the invention.

FIG. 4 diagrammatically illustrates the main steps of a method for making the face plate 10 or other lining elements according to the invention. A ladle 20 contains molten metal 21 tapped from a cupola furnace 22. Apart from the titanium and a small amount of iron, the composition of the melt 21 corresponds to the composition of the finished lining element, i.e. it corresponds to the composition of the matrix or continuous phase in which the titanium carbide grains are embedded in the finished lining element. Titanium in the form of granulated ferrotitanium (70 percent of titanium and 30 percent of iron) supplied from a container 23 is added to the melt 21 in a quantity corresponding to the desired titanium content of the finished element. At least a portion of the ferrotitanium may be added in the furnace immediately prior to the tapping.

Immediately after the ferrotitanium has been added to the melt 21 and throughly mixed therewith, the metal is poured into a shell mold 24 through the bottom of the ladle 20. The maximum time that can be permitted to elapse between the bringing together of the titanium and the carbon-containing melt 21 and the solidification of the metal in the mold 24 may vary according to the particulars of each specific case. However, it should be as short as possible and in any case not longer than 30 minutes. In fact, in many cases it will be necessary to make this time considerably shorter, and a general maximum time is about 15 minutes. After the cast lining element has been removed from the mold, it is subjected to a customary heat treatment.

The following Table 2 gives four examples of alloys for disc refiner face plates according to the invention and shows the hardness and average surface deviation $R_a$ of face plates made from these alloys. For comparision, the table also gives the corresponding data of face plates made from a reference alloy of a type customarily used for disc refiner face plates. Composition percentage figures are by weight. In addition to the alloy components for which composition figures are given in the table, the alloys contain iron as the base metal and one or more of the other alloy components set forth in Table 1 and in the ranges given in that table.

TABLE 2

| Alloy component | Alloy I | Alloy II | Alloy III | Alloy IV | Reference alloy |
|---|---|---|---|---|---|
| C | 0.9 | 0.8 | 1.6 | 1.6 | 2.9 |
| Cr | 1 | — | 12 | 17.0 | 2.0 |
| Ni | 4 | 18 | — | 1.6 | 5 |
| Mo | 3 | 5 | — | 0.7 | — |
| Ti | 3 | 3.5 | 3 | 2.3 | — |
| Co | — | 9 | — | — | — |
| V | — | — | 0.8 | — | — |
| Heat treatment | Ageing 560° C/3h | Ageing 480° C/4h | Austenitizing 1020° C/30 min. Annealing 250° C/2h twice | Austenitizing 1020° C/30 min. Annealing 250° C/2h twice | No heat treatment |

TABLE 2-continued

| Alloy component | Alloy I | Alloy II | Alloy III | Alloy IV | Reference alloy |
|---|---|---|---|---|---|
| Hardness after heat treatment $HR_C$ | 57 | 52–56 | 57 | 54 | 54 |
| Average surface deviation $R_a$ microns | 0.57 | 0.51 | 0.27 | 0.60 | 0.13 |

The face plates were made in accordance with the above-described procedure with the modification that a portion of the total quantity of the ferrotitanium was added to the molten matrix metal in the melting furnace while the rest of the ferrotitanium was added during the tapping of the molten metal into the ladle.

The first and last face plate of each series were tested in respect of the size and distribution of the titanium carbide grains and of the average surface deviation. The testing of the size and distribution showed that the maximum average size was about 5 microns in most cases, a very large majority of the grains being larger than about 1.5 microns.

The distribution was substantially uniform throughout the cross-section of the plates, although in some cases the grains in the ridges were somewhat smaller than the grains in the body. Relatively few grains, about 0.5 percent of the total number, had a size in excess of about 10 microns. The average distance between neighboring titanium carbide grains varied from about 10 microns to about 16 microns.

Face plates made from alloy E have been used in pulp production for extended periods, yielding the advantageous results accounted for hereinabove.

What we claim is:

1. In a pulp refining apparatus having a lining element, the improvement wherein the lining element is a casting of an alloy consisting essentially of from 1.0 to 5.0 percent by weight of titanium present as titanium carbide grains in a matrix of a steel containing from 0.4 to 2.2 percent by weight of carbon, a maximum of 2.0 percent by weight of silicon, a maximum of 2.0 percent by weight of manganese, a maximum of 0.03 percent by weight of phosphorus, a maximum of 0.03 percent by weight of sulphur, a maximum of 20 percent by weight of chromium, a miximum of 20.0 percent by weight of nickel, a maximum of 6.0 percent by weight of molybdenum, a maximum of 10 percent of cobalt, a maximum of 1.5 percent by wt. of vanadium, the balance being essentially iron, said titanium carbide grains having a maximum average size of about 10 microns, said grains being substantially uniformly distributed throughout the steel casting with an average distance between neighboring grains of from about 3 to about 30 microns.

2. Lining element as claimed in claim 1 in which at least 95 percent of the total number of titanium carbide grains have a size less than about 10 microns.

3. Lining element as claimed in claim 1 in which the titanium content is from 1.0 to 3.5 percent by weight.

4. Lining element as claimed in claim 1 in which the titanium content is about 2.5 percent by weight.

5. Lining element as claimed in claim 3 in which the average distance between neighboring titanium carbide grains is from about 10 to about 30 microns.

6. Lining element as claimed in claim 3 in which the matrix contains from 0.6 to 1.6 percent by weight of carbon, from 0.3 to 1.0 percent by weight of silicon, from 0.2 to 1.0 percent by weight of manganese, a maximum of 0.03 percent by weight of phosphorus, a maximum of 0.02 percent by weight of sulphur, from 16 to 18 percent by weight of chromium, from 1.0 to 2.0 percent by weight of nickel, from 0.5 to 1.0 percent by weight of molybdenum, the balance being essentially iron.

* * * * *